US005778982A

United States Patent [19]

Hauck et al.

[11] Patent Number: 5,778,982

[45] Date of Patent: Jul. 14, 1998

[54] FIXED HEAD INFLATABLE PACKER WITH FULLY REINFORCED INFLATABLE ELEMENT AND METHOD OF FABRICATION

[75] Inventors: Emil Hauck, Littleton; Henry A. Baski, Lakewood, both of Colo.

[73] Assignee: Baski Water Instruments, Inc., Englewood, Colo.

[21] Appl. No.: 441,649

[22] Filed: May 15, 1995

Related U.S. Application Data

[63] Continuation-in-part of Ser. No. 144,133, Oct. 27, 1993, abandoned.

[51] Int. Cl.[6] ..... E21B 33/127

[52] U.S. Cl. ..... 166/387; 166/187; 277/334

[58] Field of Search ..... 166/187, 387; 277/34, 34.6, 30

[56] References Cited

U.S. PATENT DOCUMENTS

| | | | |
|---|---|---|---|
| 1,190,790 | 7/1916 | Moser . | |
| 1,547,240 | 7/1925 | Steele . | |
| 2,098,484 | 11/1937 | Brundred et al. | 166/10 |
| 2,143,746 | 1/1939 | Spang | 166/10 |
| 2,611,437 | 9/1952 | Lynes | 166/10 |
| 2,643,722 | 6/1953 | Lynes et al. | 166/10 |
| 2,734,582 | 2/1956 | Bagnell | 166/187 |
| 2,779,419 | 1/1957 | Mounce | 166/187 |
| 2,872,230 | 8/1959 | Desbrandes | 288/6 |
| 3,044,553 | 7/1962 | Bradley | 166/137 |
| 3,054,455 | 9/1962 | Keltner | 166/187 |
| 3,259,192 | 7/1966 | Hyde | 166/187 X |
| 3,280,916 | 10/1966 | Barrington | 166/148 |
| 4,003,581 | 1/1977 | Hutchison | 277/34.6 |
| 4,191,383 | 3/1980 | Baker et al | 277/34.6 X |
| 4,310,161 | 1/1982 | Streich | 277/34 |
| 4,372,562 | 2/1983 | Carter, Jr. | 277/34 |
| 4,406,461 | 9/1983 | McGill | 277/34.6 |
| 4,500,095 | 2/1985 | Schisler et al. | 277/34 |
| 4,614,346 | 9/1986 | Ito | 277/34 |
| 4,886,117 | 12/1989 | Patel | 166/187 |
| 5,183,108 | 2/1993 | Lee, Jr. et al. | 166/187 |
| 5,205,567 | 4/1993 | Quinlan et al. | 277/34 |

*Primary Examiner*—Hoang C. Dang
*Attorney, Agent, or Firm*—Stephen A. Gratton

[57] ABSTRACT

An inflatable packer includes a packer mandrel and an inflatable element reinforced across its entire length and attached at each end to the packer mandrel. The inflatable element is formed of multiple layers of elastomeric material including reinforcing plies of an elastomeric base material reinforced with helically wound strands of a reinforcing material. The reinforcing strands are evenly spaced and parallel to one another and are oriented at a predetermined helical angle with respect to a longitudinal axis of the packer. The helical angle and modulus of elasticity of the reinforcing strands can be selected to allow the inflatable element to expand by a predetermined amount even though its ends are fixed.

35 Claims, 3 Drawing Sheets

FIXED HEAD INFLATABLE PACKER WITH FULLY REINFORCED INFLATABLE ELEMENT AND METHOD OF FABRICATION

This is a continuation-in part of application Ser. No. 08/144,133 filed Oct. 27, 1993, now abandoned.

FIELD OF THE INVENTION

This invention relates to inflatable packers and more particularly to an inflatable packer having a fully reinforced inflatable element fixed at each end, and to a method for fabricating such a packer.

DESCRIPTION OF THE PRIOR ART

Inflatable packers are used extensively in the operation of wells such as oil wells, water wells and gas wells and in drilling bore holes for wells. Inflatable packers are like inflatable plugs that seal off one portion of the well from another. This allows a portion of a well (or bore hole) to be isolated for sampling, cementing or other operations to be performed in specific zones within the well.

In the simplest form, a packer comprises a length of pipe, referred to as the packer mandrel, and an inflatable element attached at each end to the outside of the mandrel. By a variety of methods which are known in the art, the inflatable element can be pressurized so that it expands and presses against the inside surface of the well or bore hole. The inflatable element thus functions to effectively seal and separate fluids located above the packer from fluids located below the packer.

In operation, the packer is lowered to a desired location within the well or bore hole and the inflatable element is expanded, using liquid or gas pressure applied from the surface. The opening through the packer mandrel provides an access conduit for injecting fluids into the well or for placing instrumentation in the well below the packer. This opening may also be used to obtain samples from well. Some applications do not require an access conduit through the packer in which case the opening through the packer mandrel is merely blanked off. After each use, the inflatable element of the packer may be deflated. This permits the packer to be removed from the well or lowered to a different portion of the well for further use. Straddle packer assemblies include two packers separated with perforated pipe. This arrangement allows fluids to be withdrawn from or injected into a specific zone of the well between the packers.

The inflatable element (or hose) is one of the most crucial parts of an inflatable packer. In general, the prior art, as depicted in issued patents and configurations presently used in the industry, shows the inflatable elements for packers falling into two distinct groups: inflatable elements having both ends fixed to the packer mandrel (i.e., fixed head packers) and inflatable elements with one of both ends allowed to slide relative to one another and to the mandrel (i.e., sliding head packers).

In either case, inflatable elements for packers are typically formed of a natural or synthetic elastomeric material such as rubber. Further, the elastomeric material may contain no reinforcing or may be reinforced with a reinforcing material. Reinforcing material is used in a variety of industries for strengthening elastomers, including the tire industry and the hydraulic hose industry. The specific type of reinforcing used is industry specific and dependent on the performance requirements demanded by a particular application. The reinforcing materials commonly used for packer inflatable elements typically comprise continuous strands of material that are embedded in the elastomeric material. These reinforcing strands may be formed of steel slats, steel wire, steel braided cable, synthetic fiber and braided synthetic or steel cords.

A reinforced inflatable element may be reinforced across its entire length. Such inflatable elements are referred to as being "fully reinforced". Alternately, an inflatable element may be "partially reinforced" containing reinforcing material only on the end portions and no reinforcing material in the center of the element.

In the past, it has been conventional practice to provide a fully reinforced inflatable element only in sliding head packers. This is because the conventional wisdom in the art teaches that a non-extensible reinforcing material requires the inflatable element to contract, or shorten, as the diameter of the inflatable element increases. The sliding head permits the inflatable element to contract in a longitudinal direction while it expands in a radial direction.

A shortcoming of sliding head inflatable packers, however, is that they are more expensive to construct than fixed head packers. The sliding head requires a polished mandrel for o-ring seals to slide over. In addition, the metal parts for sliding head packers are more difficult to machine than fixed head metal parts for most designs used in the art. Furthermore, the sliding end may not function effectively in a dirty or gritty fluid. In corrosive environments the sliding head and packer mandrel may corrode to such a degree that proper deflation of the inflatable element is prohibited. This causes the withdrawal from the well to be difficult.

Another shortcoming of sliding head packers is that because one end of the inflatable element moves relative to the packer mandrel, and hence in relation to a specific packed off zone of interest in the well or bore hole, the effective volume in the packed off zone can change slightly in response to changes of pressure in this zone. This volumetric change can be significant enough to adversely affect low permeability studies and other hydrogeologic investigations. This effect that the packer can have on zone volume is often referred to as compliance. Furthermore, the sliding ends of the inflatable element can move along the packer mandrel and force the inflatable element to expand without any inflation pressure, and cause the packer to seize in the well.

On the plus side, sliding head packers can be formed with fully reinforced inflatable elements that are more resistant to puncture, and extrusion into fractures within the well or bore hole. Sliding head packers with fully reinforced inflatable elements are thus less prone to failure by extrusion than fixed head packers having inflatable elements with partial reinforcing or no reinforcing at all. In addition, fully reinforced sliding head packers typically have higher working pressures than fixed head packers. Still further, sliding head packers typically have higher expansion ratios than fixed head packers. The prior art has developed sliding head packers with a relatively high expansion ratios (e.g., over 2). The expansion ratio being the ratio of the packer's usable hole size and the uninflated outside diameter of the packer.

By comparison, fixed head inflatable packers typically have inflatable elements with no reinforcing or inflatable elements that are only partially reinforced. When the inflatable element is reinforced only near the ends, there is a blank section of non-reinforced elastomeric material, often in the middle of the inflatable element that stretches and permits expansion of the inflatable element. The non-reinforced rubber in the center of the inflatable element however, may extrude into bore hole fractures and break. In general, for those inflatable elements that have no reinforcing, the elements may fail in one of two ways: 1) by extrusion into a bore hole fracture, and 2) by extrusion into the annular area formed by the bore hole diameter and the outside diameter of the packer. These types of inflatable elements are often used to expansion ratios in excess of 2. However, because of the lack of reinforcement, the chances of failure increase significantly with each larger hole size.

One particular example of a fixed head packer is known as an external casing packer. These packers have inflatable elements with a long section of non-reinforced rubber in the center. With a non-reinforced inflatable element there is a tendency for the inflatable element to move axially against the well or bore hole wall during installation. This movement may cause enlargement of the inflatable element which can result in packer damage and difficulty in installing the casing string.

On the plus side, unlike sliding head packers, fixed head packers may be designed to have less volumetric influence on packed off zones in a well or bore hole due pressure changes. Fixed head packers thus exhibit a low compliance. Low compliance packers have little effect on the volume of a packed off zone as the zone pressures vary.

In view of the increasingly demanding requirements for packers, it is desirable to construct inflatable packers with improved performance characteristics and in which problems as outlined above are eliminated. The present invention recognizes that a fixed head packer can be constructed with a fully reinforced inflatable element if such a packer is properly designed. A fixed head packer, constructed in accordance with the invention with a fully reinforced inflatable element, will thus incorporate many of the advantages inherent in a sliding head configuration and overcome many of the limitations of current fixed head configurations.

Accordingly, it is an object of the present invention to provide an improved fixed head packer capable of high working pressures, high expansion ratios and low compliance and a method for fabricating such a packer. It is a further object of the present invention to provide an improved fixed head packer that includes a fully reinforced inflatable element that is resistant to puncture and to failure by extrusion. It is yet another object of the present invention to provide an improved fixed head packer that is relatively inexpensive to manufacture and maintain yet with performance characteristics that are similar to more expensive sliding head packers having a high expansion ratio and working pressure. It is a still further object of the present invention to provide an improved fixed head packer having an inflatable element reinforced from end to end with separate reinforcing layers formed with reinforcing material and angles selected to provide equal strain during expansion; or different reinforcing materials and angles selected such that each material has the same percent strain of total strain.

SUMMARY OF THE INVENTION

In accordance with the present invention, an improved fixed head packer having a fully reinforced inflatable element and a method for fabricating such a packer are provided. The packer, generally stated, includes a packer mandrel and an inflatable element fixed at each end by attachment to the packer mandrel. The packer mandrel is formed as an elongated tubular member, such as pipe, having a center opening therethrough which in some applications may be closed. The ends of the inflatable element are fixedly attached to the outside diameter of the packer mandrel using an attachment means such as crimp rings similar to those used for attaching fittings to hydraulic hoses. An inflation means is provided for introducing an inflation media (liquid or gas) into the inflatable element in the area between the inside surface of the inflatable element and the outside diameter of the packer mandrel.

The inflatable element is formed of multiple layers of resilient elastomeric materials. The inflatable element includes at least one, but preferably two or more pairs of reinforced plies comprising an elastomeric base material reinforced from end to end with a matrix of a reinforcing material. The reinforcing material provides increased strength and puncture resistance for the inflatable element. In addition, the reinforcing material is designed to elastically stretch or elongate by a predetermined amount upon inflation at the Inflatable element to permit a desired expansion of the inflatable element. The inflatable element may also include an inner tube and an outer tube with the reinforcing plies sandwiched therebetween. Such a lathered structure may be assembled and then vulcanized to fore a unitary structure. The number of reinforced plies as well as the thicknesses of the different layers can be selected to provide the strength necessary for a particular application.

The reinforcing material preferably has a modulus of elasticity which permits an elastic elongation for the Reinforcing material of from 1% to 30% of its unstretched length. As an example, the reinforcing material may be formed of a synthetic cord such as polyester, nylon or rayon that allows large elastic strain or deformation. These reinforcing cords may be embedded in an elastomer such as natural or synthetic rubber with the cords aligned parallel to one another and evenly spaced throughout the layer. In addition, the reinforcing cords may be oriented at some helical angle with respect to a longitudinal axis of the packer to form a spiral or helically wound reinforcing structure. Depending on the packer application, this helical angle may be between about 1° to 35°. The exact value of the helical angle will be dependent on size and performance characteristics required of a particular packer.

In addition, the inflatable element is constructed to provide a substantially equal strain within the different plies during inflation of the inflatable element. As used herein the term "strain" refers to tensile strain in the reinforcing material expressed as the ratio of the elongation at inflation to the original length. In other words, the amount of elongation of the reinforcing material in each ply during inflation is matched. The strain equalization between the plies helps to minimize stresses within the inflatable element, preventing the zipper effect of successive plies failing after an initial ply failure due to over strain. The strain equalization is a function of the modulus of elasticity, the helical angles of the reinforcing material, the length of the element, and the thinning of the element thickness during expansion. Different reinforcing materials can be used in constructing the different reinforcing plies of the inflatable element to provide lower packer compliance and a more barrel (cylindrical) shape of the expanding element. For example, a 15% elongation material such as nylon cord can be used to form some of the plies and a 5% elongation material such as kevlar can be used on other plies.

As an example, and dependent on other parameters to be more fully hereinafter discussed, reinforcement strands that can elongate 15%, and placed in helical angles in the range of from 4° to 8° for a 6 ply packer, will provide an inflatable element with expansion ratios and pressure ratings which compare favorably to state of the art sliding head packers, with a reinforced inflatable element. In another embodiment of the invention, an element may be constructed with 6 plies of 15% elongation material in a 30 to 35 degree spread, with an additional 2 plies of 5% elongation material in a 1 to 4 degree spread. The angles for the materials are selected to allow equal percentage elongation for the working hole size: 50 percent of the 15% elongation material (i.e., 7.5%), and 50 percent of the 4% elongation material (i.e., 2%). Combinations of materials such as this help the element to expand more like a cylinder of increasing radial dimension. Without such combinations of materials, the element tends to inflate as a parabola rotated around the main axis of the packer. This tendency of fully reinforced fixed head elements to inflate as a parabola, and not as a cylinder, can create high stresses and pullout forces at the ends of the crimp rings.

In another embodiment of the invention, an element may be constructed with 6 plies of 15% elongation material in a 30 to 35 degree spread, with an additional 2 plies of 4% elongation material in a 1 to 4 degree spread. This element has a smaller expansion ratio, but has a characteristic lower compliance as needed for some applications such as low permeability experiments. Thus, even though the ends of the inflatable element are fixed, the elastic stretch of the reinforcing material, before permanent deformation, can be sufficient to allow large expansion ratios, as well as other desirable features, while still allowing complete collapse of the element for retrieval from a well.

Multiple reinforced plies are required to prevent extrusion of the elastomeric material. In addition, adjacent reinforced plies of the inflatable element may include reinforcing cords wound in opposite helical directions. As an example, the even numbered plies may include reinforcing cords having a negative angle or left hand twist and the odd numbered reinforced plies may include reinforcing cords having a positive angle or right hand twist. This forms a criss-cross structure and significantly reduces the possibility of extrusion of the elastomeric materials between cords. Moreover, in some applications the helical angle may increase from the innermost to outermost layers of reinforced plies. This arrangement forms a criss-cross structure having optimal force distribution characteristics.

By appropriately selecting the helical angle, the length to diameter ratio of the inflatable element and the modulus of elasticity of the reinforcing material, the elastic stretch of the reinforcing material may be used to advantage. Such a construction permits a fully reinforced inflatable element to elastically expand to high expansion ratios (e.g., 1 to 4) even though the ends of the inflatable element are fixed.

The method of the invention, for fabricating a fixed head packer with a fully reinforced inflatable element includes the appropriate selection of the reinforcing material and helical angle which permit a desired elastic expansion of the inflatable element. Moreover, the spacing and diameter of the reinforcing material can be appropriately selected to provide the strength and abrasion resistance required for a particular application.

Using the method of the invention, a fixed head packer can be constructed less expensively than prior art sliding head packers but with improved performance characteristics including a high working pressure, a high expansion ratio and extrusion resistance. These and other objects, advantages and capabilities of the present invention will become more apparent from the following more particular description of the preferred embodiments of the invention as illustrated in the accompanying drawings.

DETAILED DESCRIPTION OF THE PREFERRED EMBODIMENT

Figure 1A:
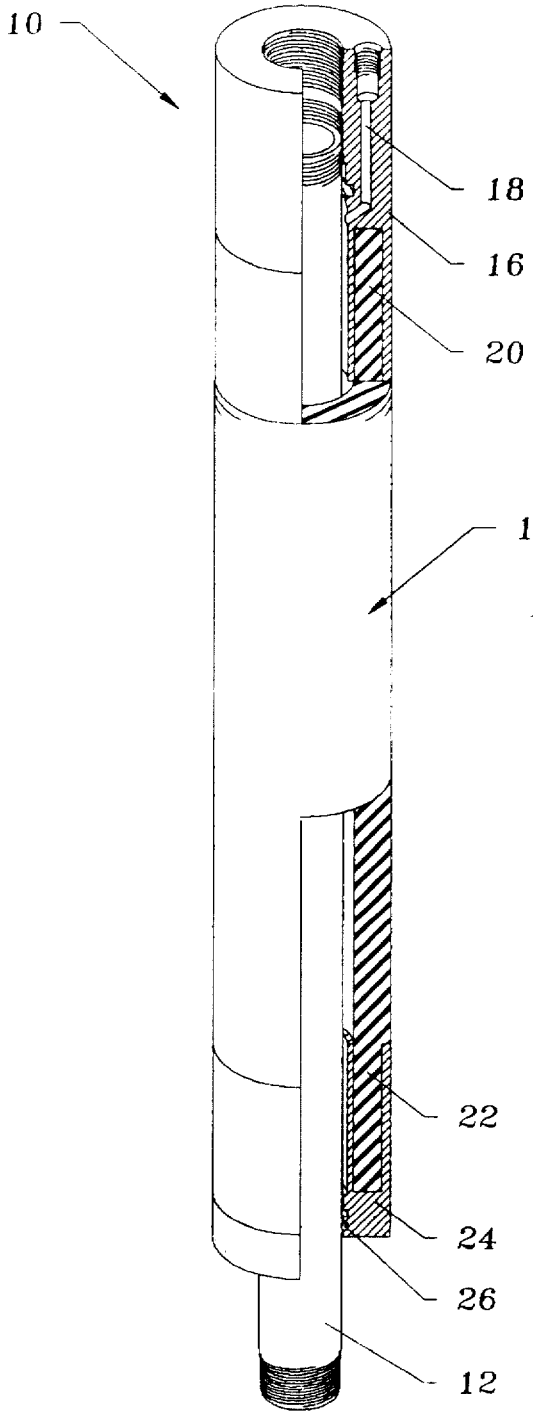
Fig. 1A (Prior Art)
FIG. 1A is a perspective view, partially cut away, of a prior art sliding head packer shown in a deflated condition.
Figure 1B:
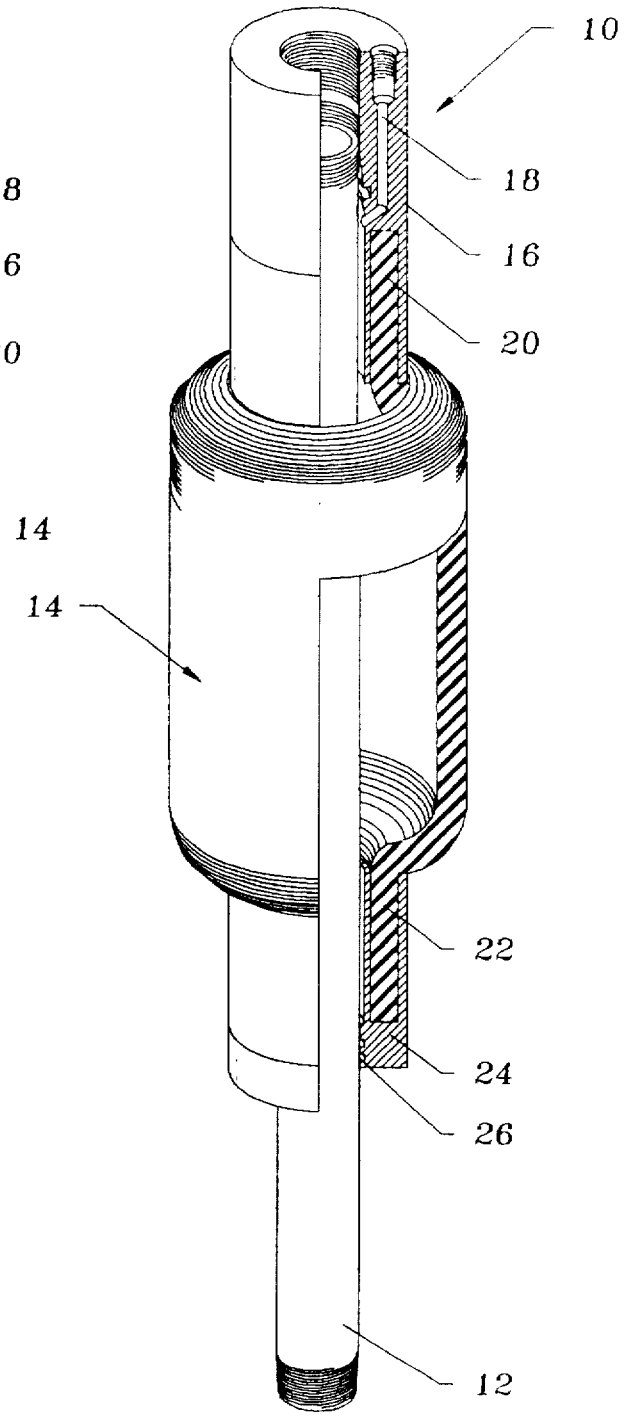
Fig. 1B (Prior Art)
FIG. 1B is a perspective view, partially cut away, of a prior art sliding head packer shown in an inflated condition.

Referring initially to FIGS. 1A and 1B, a prior art inflatable packer 10 with sliding heads is shown. The sliding head packer 10 includes a packer mandrel 12 and an inflatable element 14 slidably mounted on the packer mandrel 12. An upper end 20 of the inflatable element 14 is attached to a connection member 16. The connection member 16 is fixedly attached to the packer mandrel 12 and includes an internal inflation passageway 18. The inflation passageway 18 is in flow communication with an inflation source (e.g., pump, air compressor) for inflating the inflatable element 14 with a liquid or gaseous inflation fluid. The lower end 22 of the inflatable element 14 is attached to a sliding member 24 which slidably engages the packer mandrel 12. The sliding member 24 includes one or more o-ring seals 26 for sealingly engaging the packer mandrel 12 to provide a fluid tight seal for the inflation fluid. Upon inflation of the inflatable member 14 with an inflation fluid, the sliding member 24 and lower end 22 of the inflatable member 14 will slide upward to a position substantially as shown in FIG. 1B.

Such a sliding head packer 10 will provide relatively high expansion ratios (i.e., hole size divided by inflated outside diameter of the packer), and can be used at relatively high working pressures. Moreover, the inflatable element 14 is typically formed of a fully reinforced elastomeric material for abrasion and extrusion resistance. As previously explained, however, one shortcoming of such a sliding head packer 10 is that they are expensive to manufacture. In particular the mating sliding and sealing surfaces are difficult to machine and assemble. In addition, these sliding components are difficult to maintain and may not function effectively in some applications, such as in well bores containing a dirty or gritty fluid. The sliding member 24 can also move along the packer mandrel 12 and force the inflatable element 14 to expand without any inflation pressure, and cause the packer to seize in the hole. And, with extended use in a long term installation, the sliding members 24 can even corrode to such degree as to prevent proper deflation movement.

In general, the prior art teaches that a fully reinforced inflatable element must be mounted on such a sliding head packer 10. This is the conventional wisdom. The present invention is directed to a fixed head packer that includes a fully reinforced inflatable element.

Figure 2:
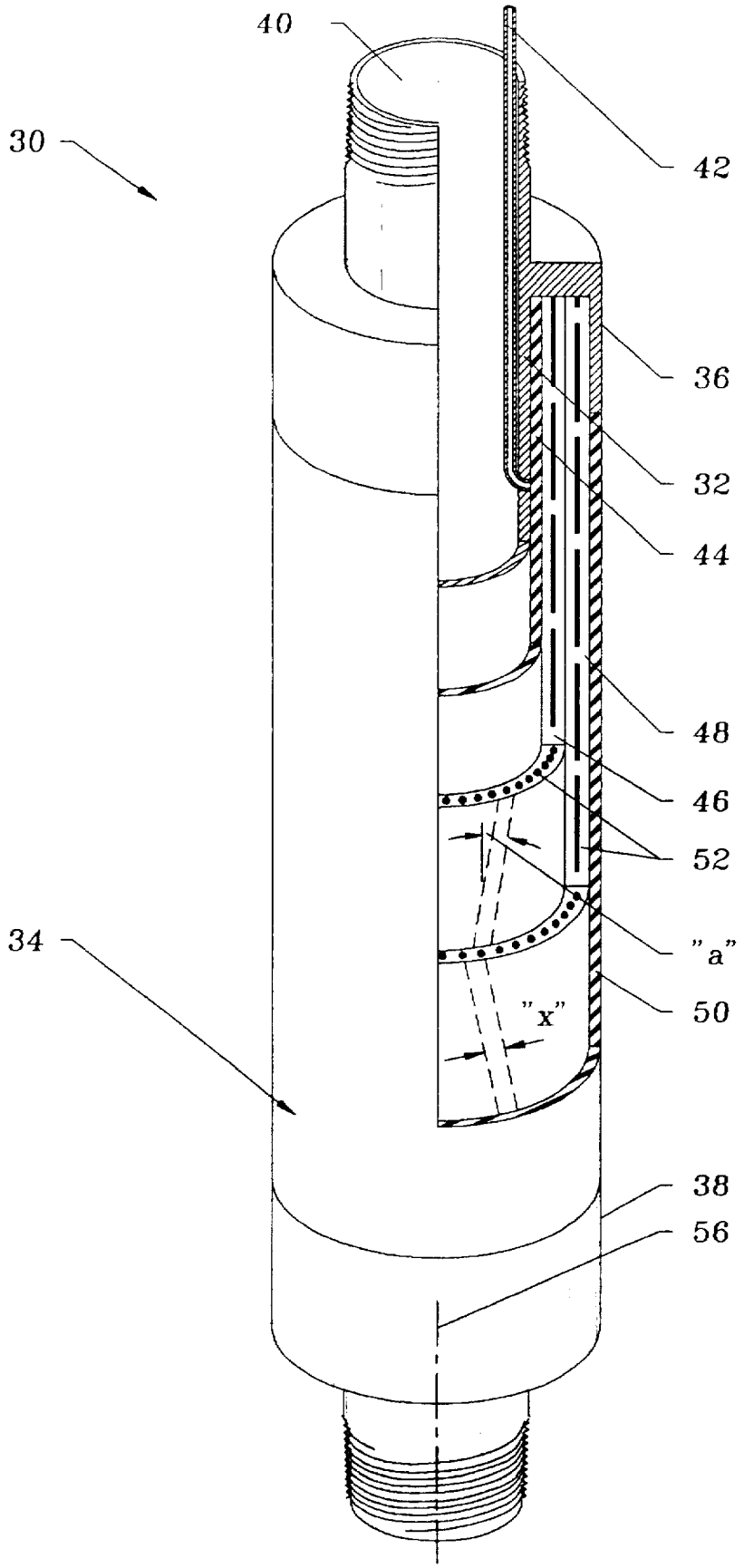
FIG. 2 is a perspective view, partially cut away, of a fixed head packer constructed in accordance with the invention having a fully reinforced inflatable element shown in a deflated condition.
Figure 3:
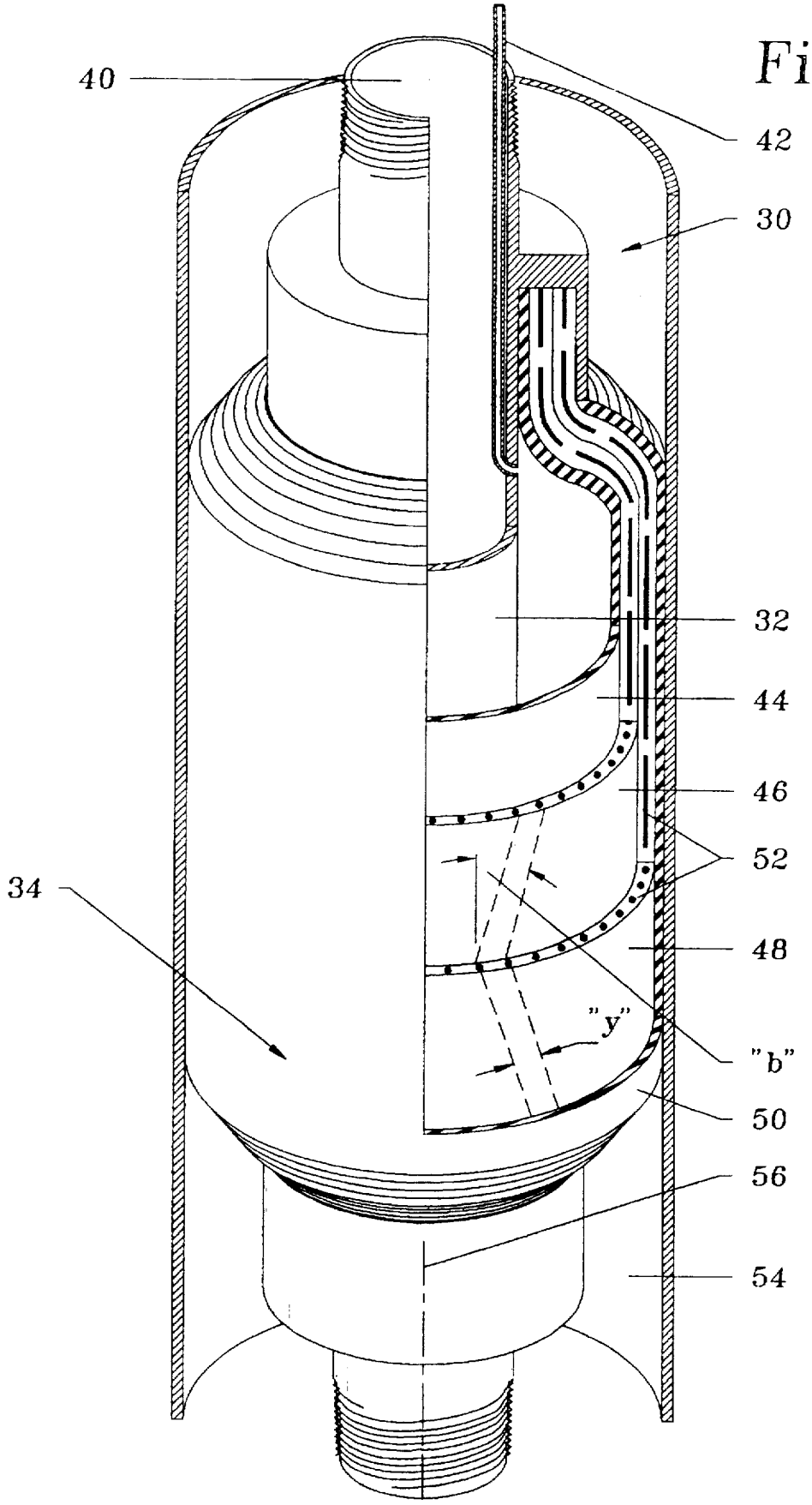
FIG. 3 is a perspective view, partially cut away, of a fixed head packer constructed in accordance with the invention having a fully reinforced inflatable element with the packer shown within a well bore and with the inflatable element inflated.

Referring now to FIGS. 2 and 3, a fixed head packer 30 constructed in accordance with the invention is shown. The fixed head packer 30 includes a tubular packer mandrel 32 and an inflatable element 34 attached to the packer mandrel 32 at each end. The fixed head packer 30 also includes an upper attachment element 36 and a lower attachment element 38 for securing the inflatable element 34 to the packer mandrel 32.

The packer mandrel 32 is formed as a section of pipe of a suitable length threaded at each end. A center opening 40 through the packer mandrel 32 allows an access conduit for sampling, grouting, injection or for placing instrumentation into a well bore 54 (FIG. 3) in which the packer 32 may be mounted. For some applications that do not require an access conduit, the center opening 40 may be plugged or blanked off.

An inflation means for inflating the inflatable element is provided by different inflation means that are known in the art. In the illustrative embodiment of the invention the inflation means comprises an inflation tube 42 placed through the center opening 40. At a lower end, the inflation tube 42 is placed through a sidewall of the packer mandrel 32 and in flow communication with the inflatable element 34. At an upper end, the inflation tube 42 may be coupled to a fluid source such as a pump or air compressor (not shown) for inflating the inflatable element 34 to a desired pressure using a pressurized liquid or gas. Such an inflation means is not intended to be limiting on the invention as the invention may be used with all inflation methods generally used in the art of inflatable packers.

The inflatable element 34 is shown in an uninflated condition in FIG. 2 and in an inflated condition in FIG. 3. The inflatable element 34 is a multi-layered structure formed of separate layers or plies of resilient elastomeric materials. More specifically, the inflatable element 34 includes an inner layer comprising an inner tube 44, middle layers comprising a pair of reinforced plies 46, 48 and an outer layer comprising an outer cover 50. Depending on the application, a greater number of layers and particularly reinforced plies 46, 48 may be employed. As an example, some applications may require ten or twenty reinforced plies of material. As is in known in the art, such a layered or multiply inflatable element 34 can be fabricated with different elastomeric materials using a vulcanization process to form a unitary structure.

The inner tube 44 and outer cover 50 are preferably formed of an elastomeric material formulated to be tough, and have high elongation characteristics. Suitable materials for the inner tube 44 and outer cover 50 include natural rubber, neoprene, nitrile, fluorocarbons such as Viton™ by DuPont and others. In fact, special applications may utilize any one of hundreds of suitable elastomeric compounds known in the industry.

The reinforced plies 46, 48 are formed of an elastomeric base material, such as natural or synthetic rubber (or others as identified above), reinforced with a reinforcing material 52. The reinforcing material 52 may be fibers, cable or cord embedded in the elastomeric base material at a desired spacing "x" and helical build angle "a" with respect to the longitudinal axis 56 of the packer 30. (In the inflated inflatable element shown in FIG. 3, the spacing of the reinforcing materials expands to "y" and the helical build angle expands to "b"). The reinforced plies 46, 48 may be fabricated by calendering the reinforcing material 52 in the desired pattern into the elastomeric base material.

Depending on the application, the reinforcing material 52 is selected with a desired modulus of elasticity and helical build angle "a" which permits stretching to achieve a desired expansion ratio and stretch pressure for the inflatable element 34. In addition, the adjacent reinforced plies 46, 48 may be formed with opposite helical orientations to provide a criss-cross structure to prevent extrusion of the elastomeric base material between the reinforcing materials. As an example, reinforcing ply 46 may include reinforcing materials 52 having a positive helical angle or right hand twist. Conversely, the adjacent reinforcing ply 48, will include reinforcing material 52 having a negative helical angle or left hand twist. For more than two reinforcing plies successive pairs of adjacent plies can be formed in this alternating pattern to provide repetitive criss crossed patterns. Furthermore, the helical build angle "a" may increase from the innermost plies to the outermost plies of a multiple ply structure to provide optimal load distribution characteristics.

For applications involving large expansion ratios (e.g., in excess of 2) the reinforcing material 52 is preferably formed of a material allowing large elastic strain (or deformation). The reinforcing material 52 will preferably have a modulus of elasticity which permits a maximum elongation before permanent deformation of about 1% to 30% of the unstretched length. For cords or cables, arranged in a helical pattern as described, the total elongation of the inflatable element will also be a function of the fiber length, diameter and spacing and of the helical build angle "a".

More specifically, the design of the inflatable element 34 having high expansion ratios and suitable strength characteristics is a function of the following parameters:

1. Maximum elastic strain of the reinforcing material 52 which is the inverse of Young's modules.
2. The maximum elastic strain of the elastomeric base material for the inflatable element 34.
3. Helical build angle "a" of the reinforcing material 52.
4. The distance "x", where "x" is the centerline distance between two adjacent cords of reinforcing material 52.
5. The outside diameter of the reinforcing material 52.
6. The overall length of the packer element 34.
7. The uninflated diameter of the packer element 34.
8. The uninflated diameter of a reinforcing ply (46 or 48).
9. The projected size of the well bore 54 for using the packer 30.

Analysis of these parameters may be performed by any of several methods, including, but not limited to, finite element analysis and numerical solutions of the transcendental algebraic models. In general, such analysis shows that as the expansion ratio is plotted against the angle "a" on a log-log plot, that the slope of the plot becomes less than 1.0 at about 10 degrees. Several factors enter into this phenomena, one of which is the cycle length (i.e., number of revolutions) of the spiral formed by an individual reinforcing cord, helically wound at a helical build angle "a" with respect to the longitudinal axis of the inflatable element. This cycle length precludes ever increasing expansion ratios with increasing length of the element. It is also noted that for optimal extrusion resistance and strength in the inflatable element, the helical build angle "a" cannot be zero (0) since there would be no crisscrossing of the reinforcing material 52. As previously explained, this criss-crossing pattern is achieved for adjacent reinforced 46, 48 plies when one ply is constructed with reinforcing cord 52 having a helical build angle of "a" and the next ply constructed with a helical build angle of "a".

The amount of elastomeric base material or rubber between the cords is important, especially for high expansion packers. Calculations must be made that can identify the elongation of the rubber in this area, to insure the material is not over strained. This can occur even when the strain in the reinforcing cord is minimal. Additional calculations are required for the end effect, in order to provide the best model to allow each ply to have similar strains.

Without limitation to the invention, an example of the analysis and basic formulae are presented here. These have proven to provide adequate results. Some variables are selected, meaning they are already known, or have values difficult to vary, such as the application hole size. Some variables must be varied in the program to optimize the elongation in a given hole size, such as the length of the element. The results give the angles at which the packer element plies should be built. The elongation of the rubber between adjacent strands is calculated to insure the elastomer is not over strained. If no suitable solution is found, some of the selected variables will have to be varied. The example is for a high expansion packer. The angles are sought that will use about half of the (selected) 15% stretch material. The ends of the elements are modeled as circular arcs. Additional programming may be added to search for optimum combinations of variables. Pressure ratings are calculated to allow determination of proper application.

Testing of inflatable elements constructed from these models has shown that for high expansion ratio packers the optimum combination of expansion ratio and extrusion resistance occurs with helical build angles "a" of about 3 to 15 degrees. Since it is desirable for the reinforcing material 52 on different reinforced plies 46, 48 to have the same amount of stretch, the initial helical build angle "a" is preferably different for each reinforcing ply. As an example, the helical build angle "a" may increase monotonically with increasing ply diameter as the general equations or analysis may dictate.

The three bars in an equation is equivalent to an equals sign. Variables subscripted with a lowercase letter are vector arrays of values. Units are shown where needed ("in" for inches, "lbf" for force in pounds, "deg" for degrees of angular measure, and "psi" for pressure in pounds per square inch).

Select the number of plys. m≡4

Vary the length of the element showing. elshow≡60·in

Select the initial, uninflated outside diameter of the element. odi≡8.625 ·in

Select the initial, uninflated inside diameter of the element. idi≡7.5·in

Select the hole size the packer will be used in. odh≡14 ·in

Select the thickness of the inner tube of the element. tti≡0.125 ·in

Select the thickness of the ply material. pti≡0.04 ·in

Select the number of strands of reinforcing per inch of material. spi≡28·1/in

Select the diameter of the reinforcing strand. sdi≡0.025 ·in

Select the maximum elastic strain of the reinforcing material. lim≡1.15

Select the strength of the cord. strength≡1700·ibf/in

Vary the maximum expanded diameter of the packer element (for odf≡21.0·in the sake of brevity, we have guessed correctly) to allow for appropriate elongation of ply material in the selected hole size Using j≡1 . . m Calculate the following quantities the mean diameter of each ply in the uninflated state:

$$pdi_j \equiv idi + 2 \cdot tti + 2 \cdot pti \cdot j - pti$$

the inside diameter of the element in the borehole $$idh \equiv \sqrt{odh^2 - odi^2 + idi^2}$$

the mean ply diameters of the element in the borehole:

-continued $$pdh_j \equiv \sqrt{odh^2 - odi^2 + (pdi_j)^2}$$

the inside diameter of the element at the maximum expanded diameter $$idf \equiv \sqrt{odf^2 - odi^2 + idi^2}$$

the mean ply diameters of the element at the maximum expanded diameter $$pdf_j \equiv \sqrt{odf^2 - odi^2 + (pdi_j)^2}$$

The $j^{th}$ angle of the $j^{th}$ ply must make the following expression go to zero.

$$elshow \cdot \frac{\frac{\lim}{\cos(angi_j)} - \frac{1}{\cos\left(atan\left(\frac{pdf_j}{pdi_j} \cdot \tan(angi_j)\right)\right)}}{\cos(angi_j) \cdot \left(\frac{\pi}{2} - 1\right)} + pdi_j - pdf_j$$

This may be solved by a variety of numerical methods. When the values are calculated, inspection will show if the angles fall within the prescribed range. If they do not, a new value of the maximum expanded diameter must be chosen, and the process repeated until a maximum expanded diameter is found that yields a set of angles that fall within the prescribed range.

A few other calculations will be needed:

$$n_j \equiv \pi \cdot pdi_j \cdot \cos(angi_j) \cdot spi$$ the number of strands on the $j^{th}$ ply $$stf \equiv sdi \cdot \frac{pdf_m - pdf_1}{pdi_m - pdi_1}$$ an approximation of the strand thickness at maximum inflation $$sth \equiv sdi \cdot \frac{pdh_m - pdh_1}{pdi_m - pdi_1}$$ an approximation of the strand thickness at borehole inflation $$swf \equiv \frac{sdi^2}{stf}$$ an approximation of the width of strand at maximum inflation $$swh \equiv \frac{sdi^2}{sth}$$ an approximation of the width of strand at borehole inflation $$fcl_j \equiv \frac{\pi \cdot pdi_j}{\tan(angi_j)}$$ the cycle length $$angf_j \equiv atan\left(\frac{\pi \cdot pdf_j}{fcl_j}\right)$$ the final angles of the reinforcing material, with respect to the axis of the element, at maximum inflation diameter $$sli_j \equiv \frac{elshow}{\cos(angi_j)}$$ the initial, uninflated, strand length $$slf_j \equiv \left(\frac{\pi}{2} - 1\right) \cdot (pdf_j - pdi_j) \cdot \cos(angi_j) + \frac{elshow}{\cos(angf_j)}$$

the strand length at maximum inflation diameter

-continued $$stret_j \equiv \frac{slf_j}{sli_j}$$ the stretch of the cord to maximum inflation diameter $$E_j \equiv \left(\frac{1}{spi} - sdi\right) \cdot \tan(angi_j)$$

$$C_j \equiv \frac{\frac{1}{spi} - sdi}{\cos(angi_j)}$$

$$F_j \equiv E_j \cdot stret_j$$

$$K_j \equiv \frac{\pi \cdot pdf_j}{n_j} \cdot \cos(angf_j) - swf$$

$$D_j \equiv \frac{K_j}{\cos(angf_j)}$$

$$Lel_j \equiv \frac{\sqrt{(D_j)^2 + (F_j)^2 - 2 \cdot D_j \cdot F_j \cdot \cos\left(\frac{\pi}{2} - angf_j\right)}}{\frac{1}{spi} - sdi} \cdot 100$$

the percent elongation of the rubber between adjacent strands on the same ply at the maximum expanded diameter $$angh_j \equiv atan\left(\frac{\pi \cdot pdh_j}{fcl_j}\right)$$ the final angles of the reinforcing material, with respect to the axis of the element, at borehole inflation diameter $$slh_j \equiv \left(\frac{\pi}{2} - 1\right) \cdot (pdh_j - pdi_j) \cdot \cos(angi_j) + \frac{elshow}{\cos(angh_j)}$$

the strand length at borehole inflation diameter $$streth_j \equiv \frac{slh_j}{sli_j}$$ the stretch of the cord to borehole inflation diameter $$Kh_j \equiv \frac{\pi \cdot pdh_j}{n_j} \cdot \cos(angh_j) - swh$$

$$Dh_j \equiv \frac{Kh_j}{\cos(angh_j)}$$

$$Fh_j \equiv E_j \cdot streth_j$$

$$Lhel_j \equiv \frac{\sqrt{(Dh_j)^2 + (Fh_j)^2 - 2 \cdot Dh_j \cdot Fh_j \cdot \cos\left(\frac{\pi}{2} - angh_j\right)}}{\frac{1}{spi} - sdi} \cdot 100$$

the percent elongation of the rubber between adjacent strands on the same ply at the borehole expanded diameter For this particular application, a maximum diameter of 21 inches gives the following solution for uninflated, or build angles:

$$\begin{array}{c} j \\ \boxed{1} \\ \boxed{2} \\ \boxed{3} \\ \boxed{4} \end{array} \quad angi = \begin{bmatrix} 5.628 \\ 5.738 \\ 5.848 \\ 5.969 \end{bmatrix} \cdot deg$$

Notice that the crisscrossing effect between plys one and two effectively creates an angle of 10.751 between the strands. At maximum expansion the angles have increased to:

$$\begin{array}{c} j \\ \boxed{1} \\ \boxed{2} \\ \boxed{3} \\ \boxed{4} \end{array} \quad angf = \begin{bmatrix} 14.654 \\ 14.804 \\ 14.954 \\ 15.128 \end{bmatrix} \cdot deg$$

In particular, the elongation of the rubber between adjacent strands on the $j^{th}$ ply, expressed in percent, of the elastomer at maximum expansion is

| $j$ | $Lel_j$ |
|---|---|
| 1 | 255 |
| 2 | 246 |
| 3 | 239 |
| 4 | 231 |

for the $j^{th}$ ply. This is within the range of most elastomers for packer use.

It is not desirable to operate the packer at its maximum expansion, for the same reason any packer is not used at its maximum diameter. In addition, at maximum expansion, the formulae have accounted for maximum elongation, so the strands are about to permanently deform or break. The stretch of the reinforcing strands at the selected borehole diameter is calculated:

$$\begin{array}{c} j \\ \boxed{1} \\ \boxed{2} \\ \boxed{3} \\ \boxed{4} \end{array} \quad streth = \begin{bmatrix} 106.3 \\ 106.3 \\ 106.3 \\ 106.3 \end{bmatrix} \cdot \% \qquad \begin{array}{l} odi = 8.625 \cdot in \\ odh = 14 \cdot in \end{array}$$

The reinforcing material selected had a maximum elongation of about 15%, and only about half or 7% is used up in going to the borehole wall.

approximate pressure to stretch the element to the final diameter $$\sum_{j=1}^{m} \frac{\pi \cdot pdi_j \cdot \cos(angi_j) \cdot strength \cdot \sin(angf_j)}{pdf_j \cdot fcl_j} = 9 \cdot psi$$

approximate internal pressure to burst the element when confined at the final diameter $$\sum_{j=1}^{m} \frac{\pi \cdot pdi_j \cdot \cos(angi_j) \cdot strength \cdot \cos(angf_j)}{[(pdf_j)^2 - idf^2] \cdot \frac{\pi}{4}} = 555 \cdot psi$$

approximate pressure to stretch the element to the borehole diameter $$\sum_{j=1}^{m} \frac{\pi \cdot pdi_j \cdot \cos(angi_j) \cdot strength \cdot \sin(angh_j)}{idh \cdot fcl_j} \cdot \frac{(streth_m - 1)}{(lim - 1)} = 4 \cdot psi$$

approximate pressure to burst the element when confined in the borehole diameter $$\sum_{j=1}^{m} \frac{\pi \cdot pdi_j \cdot \cos(angi_j) \cdot \text{strength} \cdot \cos(angh_j)}{(idh^2 - idi^2) \cdot \frac{\pi}{4}}$$

$$\frac{(stretch_m - 1)}{(lim - 1)} = 728 \cdot psi$$

The previous analysis was for a high expansion packer with a low inflation pressure. Low expansion packers with high inflation pressures, for use in low compliance applications, will typically have a spread of angles from 25 to 30 degrees (depending on the selection of materials and other variables).

Continuing now with the description of the packer 30, the attachment elements 36, 38 for securing the inflatable element 34 to the packer mandrel 40 must be able to resist high pullout forces generated by the inflatable element 34. In the illustrative embodiment of the invention the attachment elements 36, 38 are formed as metal crimp rings that are crimped to the packer mandrel 40 utilizing a hydraulic press. This type of crimp ring is used in the hose industry for attaching metal fittings to hoses. The attachment elements 36, 38 are also preferably welded to the packer mandrel 40 either before or after the crimping operation. The attachment elements 36, 38 may be formed integrally with the inflatable element 34 using a vulcanization process to form a smooth and continuous outer surface as shown.

Additional locking structures such as locking grooves may also be employed along with (or in place of) the structure shown to securely attach the attachment elements 36, 38 to the packer mandrel 40. Additional methods may also be employed to ensure that the inflatable element 34 is securely attached to the packer mandrel 40. As an example, the ends of the separate layers (inner tube 44; reinforced plies 46, 48; outer cover 50) of the inflatable element 34 may be epoxied to the packer mandrel 40.

OPERATION

Fixed head packers 30 can be constructed in accordance with the invention with a desired size and pressure rating and expansion ratio required for a particular application. In use the packer 30 is placed within a well bore 54 (FIG. 3) in an uninflated condition (FIG. 2). The packer 30 can be lowered to a desired location within the well bore 54 using techniques that are known in the art. At the desired location within the well bore 54, the inflatable element 34 of the packer 30 can be inflated using compressed air or liquid directed through the inflation tube 42. Because the Inflatable element 34 is fully, reinforced its entire length with reinforced plies 46, 48, relatively high inflation pressures may be utilized without extrusion of the elastomers between the crisscrossed reinforcement. The fully reinforced inflatable element 34 is also more resistant to puncture and extrusion. This permits the packer 34 to function effectively in demanding conditions. In addition, the reinforced plies 46, 48 of the inflatable element 34 can be reinforced with reinforcement material 52 selected with a desired and calculable modulus of elasticity to permit a desired amount of elastic stretch or elongation. This elastic stretch along with the helical build angle "a" of the reinforcement material 52 will allow the inflatable element 34 to expand by a predetermined amount to achieve a desired expansion ratio. Expansion ratios of from 1 to 4 are possible. With a high expansion ratio the packer 30 can be sized to enter a well bore 54 with a minimum of contact with the well bore 54. This helps to minimize abrasion to the packer 30 and to the well bore 54.

Such a fixed head packer 30 may also be constructed for use in low, medium, or high pressure applications and for small, medium, and large diameter packers. In general, such a fixed head packer can be constructed much cheaper than a sliding head packer.

While the invention has been described in connection with an illustrative embodiment, it is to be understood however, that the inventive concepts disclosed herein can be used in other contexts. As will be apparent then to those skilled in the art, certain changes and modifications can be made without departing from the scope of the invention as defined by the following claims.

What is claimed is:

1. An inflatable packer comprising:

a packer mandrel having a longitudinal axis;

a first attachment element and a second attachment element fixedly attached to the mandrel;

an inflatable element attached at a first end and at a second end to the packer mandrel by the first and second attachment elements, the inflatable element comprising a plurality of reinforced layers, each reinforced layer comprising an elastomeric base material reinforced with a continuous reinforcing material embedded in the base material at a predetermined helical angle with respect to the longitudinal axis, the reinforcing material extending from the first end to the second end and configured to elongate during inflation of the inflatable element by a predetermined amount, with the angle selected, and the reinforcing material selected with a modulus of elasticity, to permit a desired expansion of the inflatable element and a substantially equal percentage of maximum elastic strain in the reinforcing material of each reinforced layer during inflation of the inflatable element.

2. The inflatable packer as claimed in claim 1 wherein the helical angle is between about 1 to 35 degrees.

3. The inflatable packer as claimed in claim 1 wherein the inflatable element comprises at least two reinforced layers with the reinforcing material on a first reinforced layer oriented at a helical angle "a " and the reinforcing material on a second reinforced layer oriented at a helical angle "–a".

4. The inflatable packer as claimed in claim 1 wherein the helical angle and the reinforcing material are selected to provide an expansion ratio for the inflatable element of between about 1 to 4.

5. The inflatable packer as claimed in claim 1 wherein the reinforcing material comprises a material selected from the group consisting of cords and cables.

6. The inflatable packer as claimed in claim 1 wherein the first and second attachment elements comprise metal crimp rings.

7. A fixed head inflatable packer comprising:

a packer mandrel having a longitudinal axis;

a first attachment element and a second attachment element fixedly attached to the mandrel;

an inflatable element attached to the packer mandrel at a first end by the first attachment element and at a second end by the second attachment element, the inflatable element comprising multiple pairs of reinforced layers of elastomeric material including a first pair and a second pair of reinforced layers, each pair comprising an elastomeric base material reinforced with continuous strands of reinforcing material, the first pair of reinforced layers including a first reinforcing material configured to elongate during inflation of the inflatable element, the second pair of reinforced layers including a second reinforcing material configured to elongate during inflation of the inflatable element, each of the reinforcing materials selected with a modulus of elasticity and a helix build angle to permit a substantially equal percent of maximum elastic strain in the first reinforcing material and the second reinforcing material during inflation of the inflatable element.

8. The inflatable packer as claimed in claim 7 wherein the first and second attachment elements comprise a first crimp ring and a second crimp ring.

9. The inflatable packer as claimed in claim 7 wherein the inflatable element comprises an inner tube and an outer cover attached to said reinforcing layers.

10. The inflatable packer as claimed in claim 7 wherein the inflatable element includes matched pairs of reinforced layers each pair having one reinforced layer having strands of reinforcing material oriented around said longitudinal axis with a right hand helical twist and a mating reinforced layer having strands of reinforcing material oriented around said longitudinal axis with a left hand helical twist.

11. The inflatable packer as claimed in claim 7 wherein the helix build angle for each reinforcing layer increases from an innermost reinforcing layer to an outermost reinforcing layer, for each reinforcing material.

12. The inflatable packer as claimed in claim 7 wherein the inflatable element comprises a vulcanized inner tube and an outer cover.

13. An inflatable packer comprising:

a tubular packer mandrel having a longitudinal axis;

an inflatable element attached to the packer mandrel and reinforced from end to end, the inflatable element comprising an inner tube, first, second, third, and fourth reinforced plies and an outer cover, the reinforced plies comprising an elastomeric base material reinforced with reinforcing strands, the reinforcing strands embedded in the elastomeric base material and oriented at helical angles with respect to the longitudinal axis of from about 1 degrees to about 35 degrees, the reinforcing strands configured to elongate by a predetermined amount upon inflation of the inflatable element to allow for expansion of the inflatable element, the first and third reinforced plies having reinforcing strands oriented at helical angles "a", and the second and fourth reinforced plies having reinforcing strands oriented at helical angles "−a", the reinforcing strands in the first and second reinforced plies comprising a first material having a first modulus of elasticity, and the reinforcing strands in the third and fourth reinforced plies comprising a second material having a second modulus of elasticity, with each modulus of elasticity and helical angle selected to provide an equal percent of total strain for the reinforcing strands during inflation of the inflatable element;

a first attachment element for attaching a first end of the inflatable element to the packer mandrel; and a second attachment element for attaching a second end of the inflatable element to the packer mandrel.

14. The inflatable packer as claimed in claim 13 wherein each modulus of elasticity and each helical angle is selected to allow the inflatable element to inflate as a cylinder.

15. The inflatable packer as claimed in claim 13 wherein the reinforcing strands comprise a material selected from the group of materials consisting of polyester, nylon, rayon, kevlar, steel, glass, and carbon.

16. The inflatable packer as claimed in claim 13 wherein the reinforcing strands comprise a material having a modulus of elasticity to permit a maximum elastic elongation of the strands of between about 1% and 30% of the unstretched length of the strands.

17. The inflatable packer as claimed in claim 13 wherein the ends of the inflatable element are epoxied or vulcanized to the packer mandrel.

18. The inflatable packer as claimed in claim 13 wherein the elastomeric base material comprises a material selected from the group consisting of natural rubber or synthetic rubber.

19. The inflatable packer as claimed in claim 13 wherein the packer mandrel includes a center opening.

20. The inflatable packer as claimed in claim 13 wherein the packer mandrel has no center opening.

21. The inflatable packer as claimed in claim 13 wherein the inflatable element comprises multiple reinforcing plies and the helical angle increases from an innermost ply to an outermost ply, for each reinforcing material.

22. A method for fabricating an inflatable packer having fixed ends and a fully reinforced inflatable element comprising:

providing a packer mandrel having a longitudinal axis;

forming an inflatable element with a first layer and a second layer comprising a first reinforcing material embedded in a first elastomeric base material, and a third layer and a fourth layer comprising a second reinforcing material embedded in a second elastomeric base material with each reinforcing material extending from a first end to a second end of the inflatable element and oriented about the longitudinal axis with a predetermined helical angle;

selecting each reinforcing material with a modulus of elasticity and selecting each helical angle to allow the first reinforcing material and the second reinforcing material to elongate with a substantially equal percentage of maximum elastic strain during inflation of the inflatable element; and attaching the inflatable element at each end to the packer mandrel.

23. The method of claim 22 further comprising:

forming the first and second reinforced layers and the third and fourth reinforced layers with parallel spaced reinforcing strands helically oriented about the longitudinal axis with a right hand twist for the first and third reinforced layers and with a left hand twist for the second and fourth reinforced layers to form a criss-crossed structure.

24. The method of claim 22 further comprising:

forming each reinforced layer, with each helical angle increasing from an innermost reinforced layer to an outermost reinforced layer, for each reinforcing material.

25. The method of claim 22 wherein the inflatable element comprises a unitary structure fabricated using a vulcanization process.

26. The method of claim 22 wherein each helical angle is from about 4° to 8°.

27. The method of claim 22 wherein the first elastomeric base material and the second elastomeric base material comprise a same material.

28. The method of claim 22 wherein each helical angle is between about 1 degree and 35 degrees.

29. The method of claim 22 wherein the first material is oriented with a helical angle of from 4 to 8 degrees and the second material is oriented with a helical angle of from 1 to 4 degrees.

30. The method of claim 22 further comprising selecting the first and second elastomeric base materials such that they do not permanently deform during inflation of the inflatable element.

31. An inflatable packer comprising:

an elongated mandrel having a longitudinal axis;

an inflatable element attached to the mandrel at first and second ends thereof;

a first fixed head and a second fixed head configured to attach the inflatable element to the mandrel;

the inflatable element comprising a first reinforcing layer and a second reinforcing layer, the first reinforcing layer comprising an elastomeric base material having a first reinforcing material embedded therein, the second reinforcing layer comprising the elastomeric base material having a second reinforcing material embedded therein, the second reinforcing material comprising a different material than the first reinforcing material;

the first reinforcing material and the second reinforcing material each comprising a plurality of strands, oriented at a helical angle with respect to the longitudinal axis, and extending continuously from the first fixed head to the second fixed head;

the helical angle and a modulus of elasticity of the strands in each reinforcing layer, selected to provide a substantially equal percentage of maximum elastic strain in the strands of each reinforcing layer for a selected diameter of the inflatable element.

32. The packer as claimed in claim 31 wherein the helical angle is between about 1 to 35 degrees.

33. A method for fabricating a fixed head packer comprising:

providing a packer mandrel;

forming an inflatable element comprising a first reinforcing layer and a second reinforcing layer;

the first reinforcing layer comprising a first elastomeric base material having first reinforcing strands embedded therein, the first reinforcing strands comprising a first material extending from a first end to a second end of the inflatable element and oriented at a first helical angle with respect to a longitudinal axis of the mandrel;

the second reinforcing layer comprising a second elastomeric base material having second reinforcing strands embedded therein, the second reinforcing strands comprising a second material different than the first material and extending from the first end to the second end of the inflatable element and oriented at a second helical angle with respect to the longitudinal axis of the mandrel;

selecting the first helical angle and the second helical angle and a modulus of elasticity of the first material and the second material such that a first percentage of maximum elastic strain in the first reinforcing strands during inflation of the inflatable element is substantially equal to a second percentage of maximum elastic strain in the second reinforcing strands for a selected diameter of the inflatable element; and attaching the inflatable element to the mandrel by fixing a first attachment member at the first end and a second attachment element at the second end.

34. The method as claimed in claim 33 wherein the first elastomeric base material and the second elastomeric base material comprise a same material.

35. The method as claimed in claim 33 further comprising selecting the first helical angle and the second helical angle by considering parameters in the inflatable element using a modeling program.

* * * * *